US010874146B2

(12) United States Patent
Chau et al.

(10) Patent No.: US 10,874,146 B2
(45) Date of Patent: Dec. 29, 2020

(54) ELECTRONIC DEVICE FOR TOBACCO

(71) Applicant: Acoustic Arc International Limited, Hong Kong (CN)

(72) Inventors: Boa Fung Chau, Hong Kong (CN); Kak Man Chan, Hong Kong (CN); Yubin Xiao, Hong Kong (CN)

(73) Assignee: Acoustic Arc International Limited, Hong Kong (CN)

( * ) Notice: Subject to any disclaimer, the term of this patent is extended or adjusted under 35 U.S.C. 154(b) by 167 days.

(21) Appl. No.: 16/059,084

(22) Filed: Aug. 9, 2018

(65) Prior Publication Data

US 2020/0037663 A1 Feb. 6, 2020

(30) Foreign Application Priority Data

Aug. 1, 2018 (CN) ..... 2018 1 0866809

(51) Int. Cl.
*A24F 47/00* (2020.01)
*H05B 3/44* (2006.01)

(52) U.S. Cl.
CPC ..... *A24F 47/008* (2013.01); *H05B 3/44* (2013.01)

(58) Field of Classification Search
CPC ..... A24F 47/008; A24F 40/46; A24F 40/30; A24F 40/40; A24F 40/50
See application file for complete search history.

(56) References Cited

U.S. PATENT DOCUMENTS

2004/0149296 A1* 8/2004 Rostami ..... A24F 47/008 131/194

FOREIGN PATENT DOCUMENTS

| | | | |
|---|---|---|---|
| CN | 104770875 | A | 7/2015 |
| JP | 2006-505281 | A | 2/2006 |
| JP | 2006-519355 | A | 8/2006 |
| JP | 2008-518614 | A | 6/2008 |

OTHER PUBLICATIONS

Machine Translation of CN104770875 (Year: 2020).*

* cited by examiner

*Primary Examiner* — Eric Yaary
*Assistant Examiner* — Jennifer A Kessie
(74) *Attorney, Agent, or Firm* — Spruson & Ferguson (Hong Kong) Limited

(57) ABSTRACT

A heat-not-burn tobacco-type device for heating a cigarette has a heater and a vaporizer. The heater heats the cigarette at a heating temperature not greater than 450° C. for discouraging formation of harmful substances, such as tar and carbon monoxide, during heating the cigarette. The vaporizer is used to vaporize a liquid for producing smoke and/or for enhancing a taste of the cigarette. The vaporizer and the heater are arranged to work simultaneously or independently to generate two bodies of aerosol, wherein these two bodies of aerosol pass through two independent gas channels and meet together for a smoker to inhale thereafter. Hence, the device not only meets visual needs of the smoker in the smoke and/or enhances the taste of the cigarette, but also discourages generation of the harmful substance.

18 Claims, 7 Drawing Sheets

ELECTRONIC DEVICE FOR TOBACCO

CROSS-REFERENCE TO RELATED APPLICATION

This application claims priority to Chinese Patent Application No. 201810866809.0, filed on Aug. 1, 2018, the disclosure of which is incorporated by reference herein in its entirety.

FIELD OF THE INVENTION

The present invention relates to a device for heating tobacco in a cigarette to enable a smoker to smoke the cigarette.

BACKGROUND

With the development of science and technology, smoking has become a consensus for human beings. The highest temperature of common tobacco burning can reach 800-900° C. Tobacco produces harmful substances such as tar and carbon monoxide at a high temperature and in an anoxic environment. Chemical substances such as benzopyrene, hydrogen sulfide and nitrosamine contained in tar have been confirmed to be carcinogenic chemicals, greatly affecting human health. As people's awareness of health increases, more and more smokers are choosing to use electronic cigarettes as substitutes, which are less harmful.

There are currently two main types of electronic cigarettes in the market. One is smoke oil type electronic cigarettes and the other is heat-not-burn tobacco-type heating devices. For the smoke oil type cigarette, the advantage is that the heating temperature is relatively low, and less harmful substances such as tar are generated. However, its taste and smoking experience differs a lot when compared to smoking conventional tobacco. For a heat-not-burn device for heating tobacco, a cigarette is inserted to the device and the cigarette is heated instead of burning. When the cigarette is heated by the device, the smoker enjoys smoking like taking a conventional cigarette. This kind of smoking gives a user's feeling similar to smoking the conventional cigarette. This smoking type covers quite many varieties of tastes close to the taste of conventional cigarette. However, when compared to smoking the conventional cigarette, users are likely to feel that the amount of smoke generated by the device is very small, thereby degrading users' experience.

In view of the forgoing observation, there is a need in the art for a novel to develop a new heat-not-burn device for heating a tobacco cigarette, which is suitable for housing tobacco cigarettes of any brand in the market, and effectively solves the above-mentioned problems.

SUMMARY OF THE INVENTION

The present invention provides a device for heating a tobacco cigarette to enable a smoker to smoke the cigarette, where the cigarette is insertable into the device.

The device comprises a heater configured to heat the cigarette at a heating temperature not higher than 450° C. for discouraging formation of harmful substances during heating the cigarette. Advantageously and preferably, the heating temperature is further limited to be in a range of 250° C. to 350° C. The heater comprises a first heating element. The first heating element is arranged to heat tobacco materials in the cigarette so as to generate a first body of aerosol when the cigarette is inserted into the device.

According to one embodiment of the present invention, the first heating element generates heat to heat the cigarette by electrical power. In one option, the first heating element is selected to have a resistance between 0.1Ω and 5.0Ω. Preferably, the first heating element is a heating mesh. In addition, it is preferable that the heating mesh has a cylindrical shape. The heater may further comprise a metal tube inserted into the heating mesh for substantially-uniformly transferring heat from the heating mesh to the cigarette. A heat insulating sleeve may be included in the heater for heat-insulating the first heating element from a remaining part of the device.

The device further comprises a vaporizer for vaporizing a liquid. The liquid comprises one or more chemicals at least one of which is selected for producing smoke or for enhancing a taste of the cigarette. The vaporizer is configured to direct the vaporized liquid in the form of aerosol to the cigarette when the smoker smokes the cigarette. The vaporizer comprises a second heating element. The second heating element is arranged to heat a liquid so as to generate a second body of aerosol.

In one embodiment, the vaporizer comprises a vaporizer housing having a function of storing the liquid, a second heating element for vaporizing the liquid, and a liquid guiding medium for sucking the liquid from the vaporizer housing to the second heating element.

Preferably, the vaporizer is detachably mountable to a main body of the device so as to facilitate a person to clean the vaporizer or to add the liquid.

Preferably and advantageously, the heater and vaporizer have their own smoke/vapor pass channels and can work independently. The second body of aerosol from the vaporizer does not go through tobacco materials in the cigarette. Hence, all of the second body of aerosol can be exported out of the disclosed device instead of being absorbed by the tobacco materials, and therefore the amount of smoke can be increased.

In a preferable embodiment, through a hybrid configuration of making the heater and vaporizer together in the device, it not only meets the visual needs of smokers in the smoke, but also discourages generation of harmful substances such as tar and carbon monoxide. At the same time, the disclosed device provides a volatile substance in tobacco by medium and low temperature heating to enhance the taste, and achieves the goal of having low tar and low hazardous substances.

Other aspects of the present invention are disclosed as illustrated by the embodiments hereinafter.

DETAILED DESCRIPTION

The present invention provides a device for heating tobacco in a cigarette so as to enable a smoker to smoke the cigarette, where the cigarette is insertable into the device. Specifically, the device as disclosed is a heat-not-burn device. As will be shown hereinafter, potential advantages of the disclosed device are at least three-fold. First, when compared to direct smoldering of the cigarette, a lower temperature is used by the device to heat the cigarette so that the resultant generated amount of, e.g., tar, which leads to undesirable health effects to a smoker, is reduced. Second, a vaporizer is included in the device to vaporize a liquid for, e.g., increasing a volume of smoke even in the presence of reduced heating temperature. It enhances the user experience. Furthermore, chemicals for enhancing the taste of the cigarette, such as nicotine, may also be added into the liquid and vaporized together. Third, a gas channel is used in the device to transport the vaporized liquid from the vaporizer to a filter tip of the cigarette without a need for the vaporized liquid to pass through tobacco shreds, thereby preventing absorption of the vaporized liquid in the tobacco shreds and also preventing the nicotine in the tobacco shreds dissolve in the vaporized liquid as well.

Figure 1:
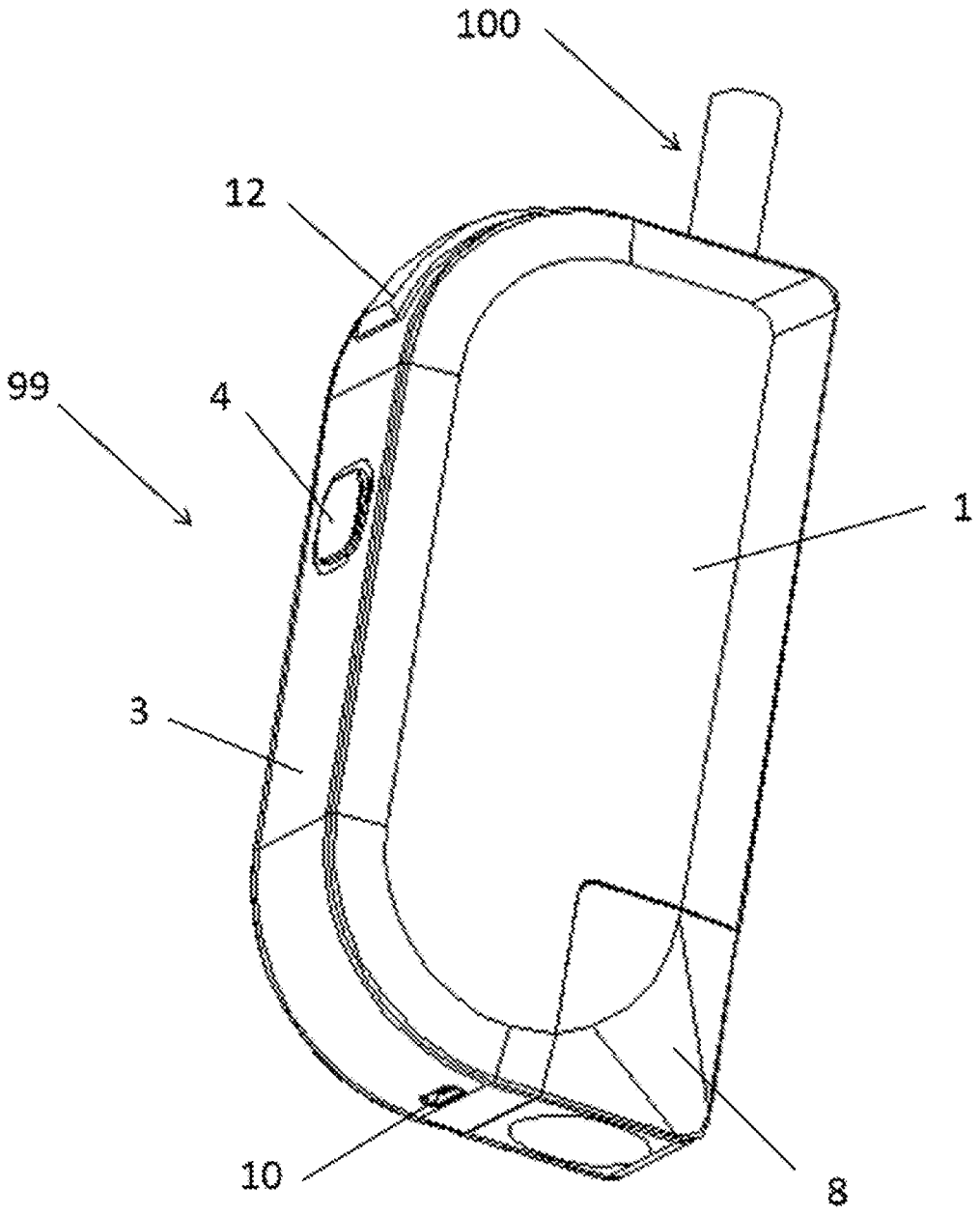
FIG. 1 depicts, in accordance with an exemplary embodiment of the present invention, a device for heating a cigarette inserted therein.
Figure 2:
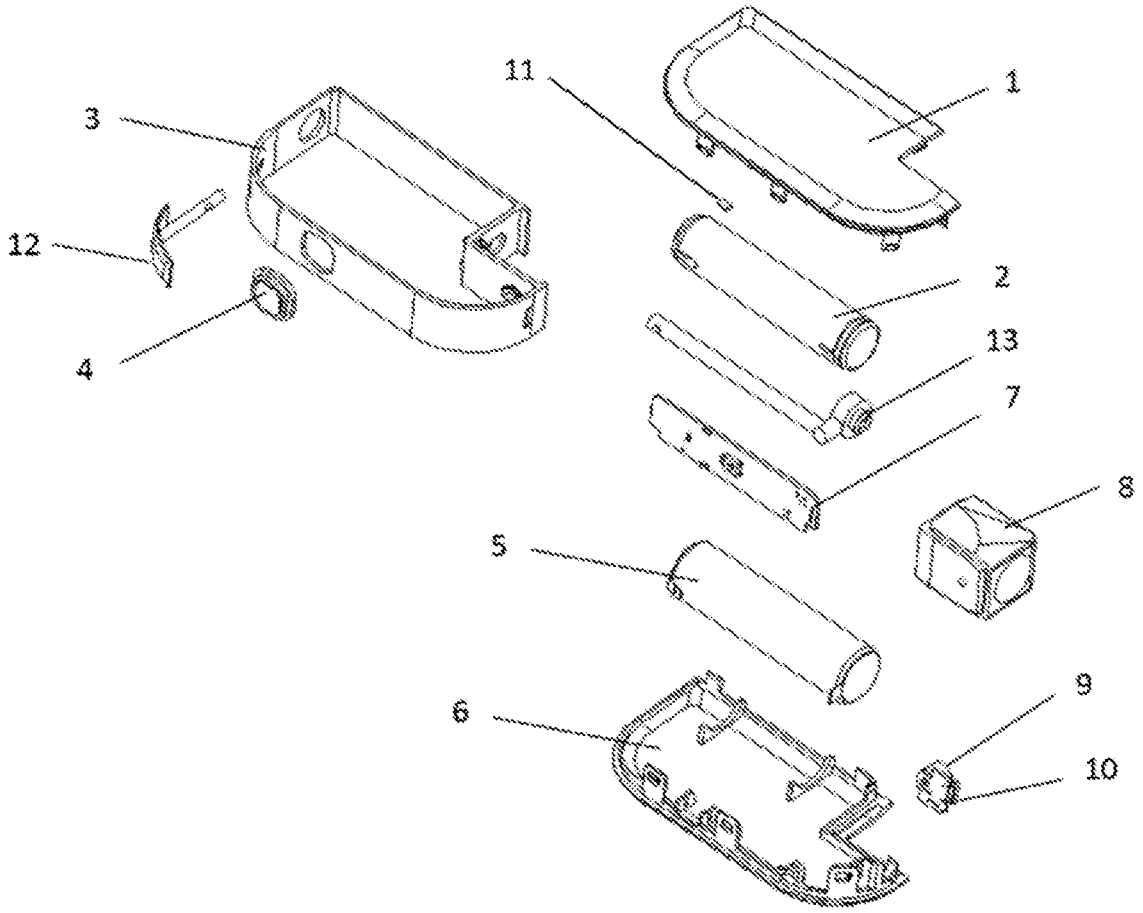
FIG. 2 depicts an exploded view of the device of FIG. 1.
Figure 3:
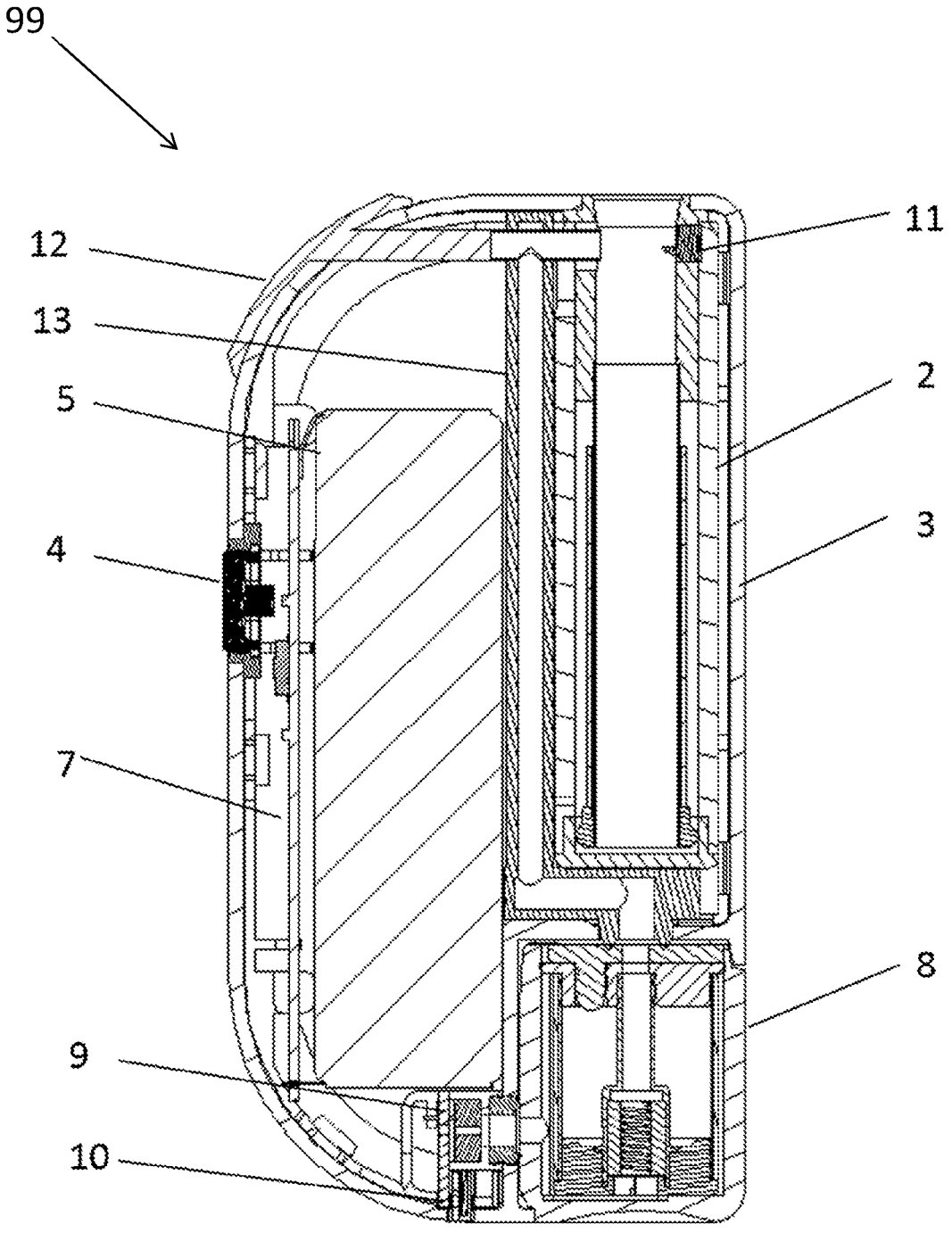
FIG. 3 depicts a cross-section view of the device of FIG. 1.

Exemplarily, the disclosed device is illustrated with the aid of FIGS. 1-3. FIG. 1 depicts a device 99 configured to heat a cigarette 100. The cigarette 100 is insertable into the device 99 such that one end of the cigarette 100 containing tobacco is penetrated into the device 99 for heating. In accordance with an exemplary embodiment of the present invention, an exploded view of the device 99 is depicted in FIG. 2. FIG. 3 depicts a cross-sectional view of the device 99.

The device 99 comprises a housing 3, a right cover 1 and a left cover 6 all for providing mechanical support to the device 99. The device 99 further comprises a heater 2, a start switch 4, a controller 7, a vaporizer 8, an airflow sensor 9, a USB port 10, a safety switch 11, a pushrod 12 and a vapor channel 13, the functions of all of which will be explained soon. The controller 7 is an electronic controller.

In addition, a battery 5 is installable in the device 99 for supplying electrical power to various parts of the device 99. The battery 5 installed in the device 99 may be a disposable battery power source or a rechargeable battery power source. Preferably and advantageously, the device 99 adopts a rechargeable battery power source, and may be recharged by electrical power received through the USB port 10, for example.

The device 99 is configured such that the cigarette 100 having a size compliant to any one relevant industrial standard is insertable into the device 99. For example, the cigarette 100 may be a standard size, or a compact size with a high concentration of tobacco.

The heater 2 is used for heating the cigarette 100 and maintaining the heating temperature at a certain temperature predetermined for limiting or preventing formation of harmful substances by high temperature, such as tar. Typically, if a smoker directly smokes the cigarette 100 in a common manner and without using the disclosed device 99, the smoldering temperature is normally between 600° C. to 700° C., causing a lot of harmful substances, in particular tar, to be generated. The Inventors have observed that if the cigarette 100 is not smoldered but is heated, and the heating temperature is kept below 450° C., or more advantageously between 250° C. to 350° C., the amount of tar that is produced is substantially reduced. The formation of harmful substances during heating the cigarette 100 is discouraged. In accordance with one embodiment of the present invention, the heater 2 is configured to heat the cigarette 100 to a heating temperature of at most 450° C. Preferably and advantageously, the heating temperature is selected to be in a range of 250° C. to 350° C.

Figure 4:
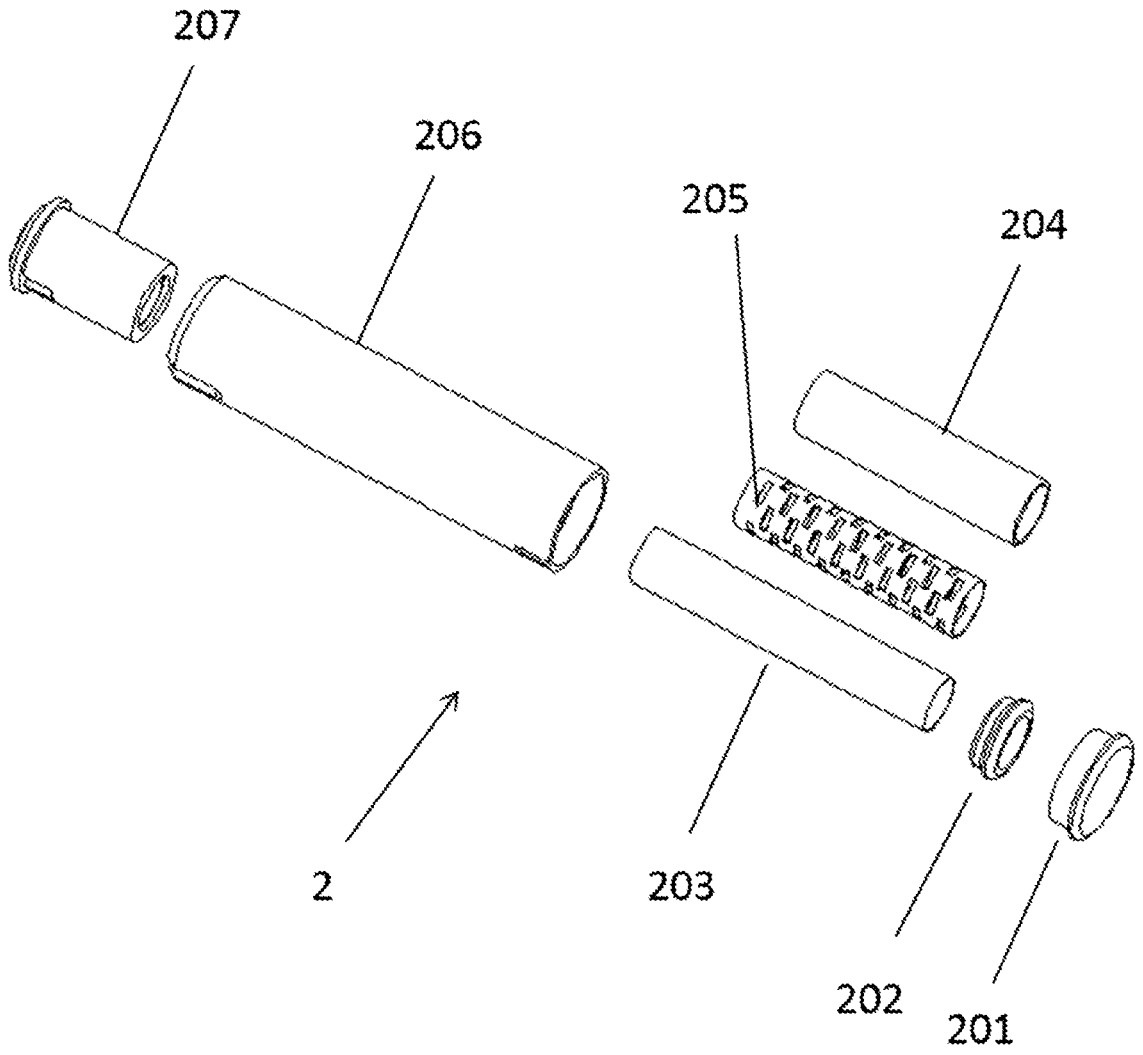
FIG. 4 depicts an exploded view of a heater used in the disclosed device according to one embodiment of the present invention.

FIG. 2 depicts an exploded view of the heater 2 in accordance with one embodiment of the present invention. The heater 2 includes a first heating element 205 for generating heat to heat the cigarette 100 by electrical power, and a heat insulating sleeve 204 for heat-insulating the first heating element 205 from the rest of the device 99. The first heating element 205 is arranged to heat tobacco materials in the cigarette 100 so as to generate a first body of aerosol when the cigarette 100 is inserted into the device 99. The first body of aerosol appears as smoke. The first heating element 205 may be, but not limited to, a heating mesh, a heating wire, a heating tube, and the like. Preferably, the first heating element 205 is a heating mesh. (In FIG. 4, a heating mesh is shown as the first heating element 205.) Without loss of generality, the heating mesh is used to represent the first heating element 205 in the forthcoming description of the invention. The heating mesh is preferably designed with a cylindrical shape in which the cigarette 100 can be inserted therein. Also preferably, the heating mesh has a resistance that is between 0.1Ω and 5.0Ω. Generally, the number of meshes in the heating mesh is lower than 400. Preferably, the number of meshes is between 30 and 200. The heating mesh may be closely attached to the cigarette 100. Alternatively, a metal tube 203 may be inserted into the heating mesh as a heat conducting medium to improve heating uniformity to the cigarette 100, thereby allowing heat to be substantially-uniformly transferred from the heating mesh to the cigarette 100. The metal tube 203 can also be served as a physical support to the heating mesh. The heat insulating sleeve 204 may be made of ceramic, polyetherketone (PEK), Teflon, or other heat-proof materials. Preferably, in a certain embodiment of the invention, Teflon is used as the insulating sleeve material. The heater 2 may further include a bottom cover 201, a silicone pad 202, a fixed tube 206, a connecting tube 207, all as mechanical parts of the heater 2. The fixed tube 206 forms an external casing of the heater 2.

As a preferred embodiment of the device 99, the device 99 further includes a safety switch 11 capable of sensing whether the cigarette 100 is inserted into the device 99. The start switch 4 and the safety switch 11 are both electrically connected to the controller 7. By adopting such a structure, the safety switch 11 senses whether the cigarette 100 is inserted into the device 99. If the cigarette 100 is inserted, the safety switch 11 is closed. When the safety switch 11 and the start switch 4 are simultaneously closed, the device 99 works normally; otherwise, the device 99 does not work. It can be seen that the safety of using the device 99 is improved by setting the aforementioned two-stage switching cascade of the safety switch 11 and the start switch 4. In one embodiment, the safety switch 11 is also provided with a function of recording the number of puffs. The number of puffs for the user is used to remind the user of the remaining amount of cigarette to be smoked, thereby avoiding excessive consumption by the user. The function of recording the number of puffs can also be done by other separate components.

The vaporizer 8 is used for vaporizing liquid substances such that when the smoker smokes the cigarette 100, the vaporized substances are released outside the device 99. The main use of the vaporizer 8 is to enhance the user experience. In one advantageous use, the liquid substances may be used to increase the amount of smoke generated in smoking. The smoke generated by the liquid substances may be used to supplement the cigarette smoke that is produced in a lesser amount due to the heater 2 heating the cigarette 100 at a temperature that is lower than the one commonly used in directly smoldering the cigarette 100. In another advantageous use, one or more additives, such as nicotine, may be vaporized to intensify the taste of the cigarette 100.

Figure 5:
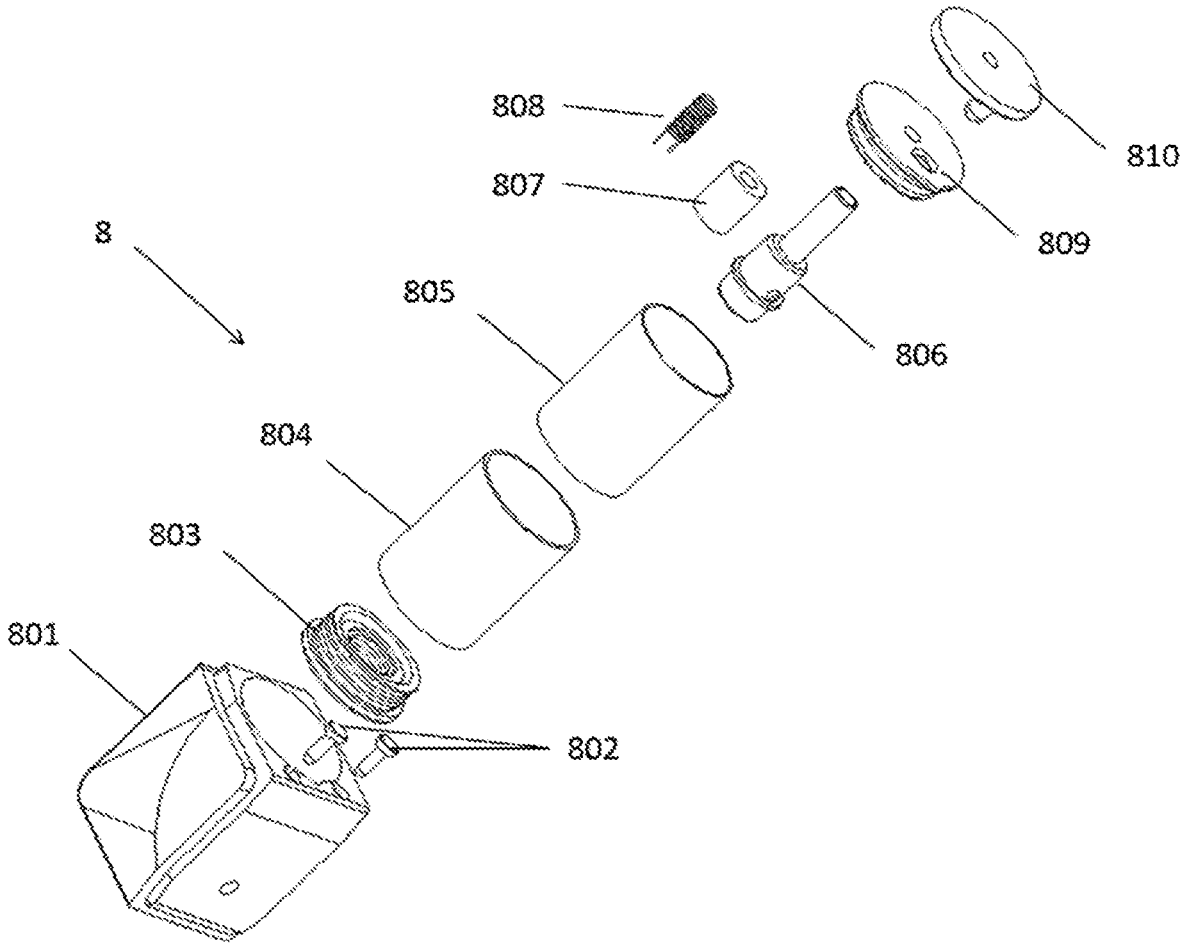
FIG. 5 depicts an exploded view of a vaporizer used in the disclosed device according to one embodiment of the present invention.
Figure 6:
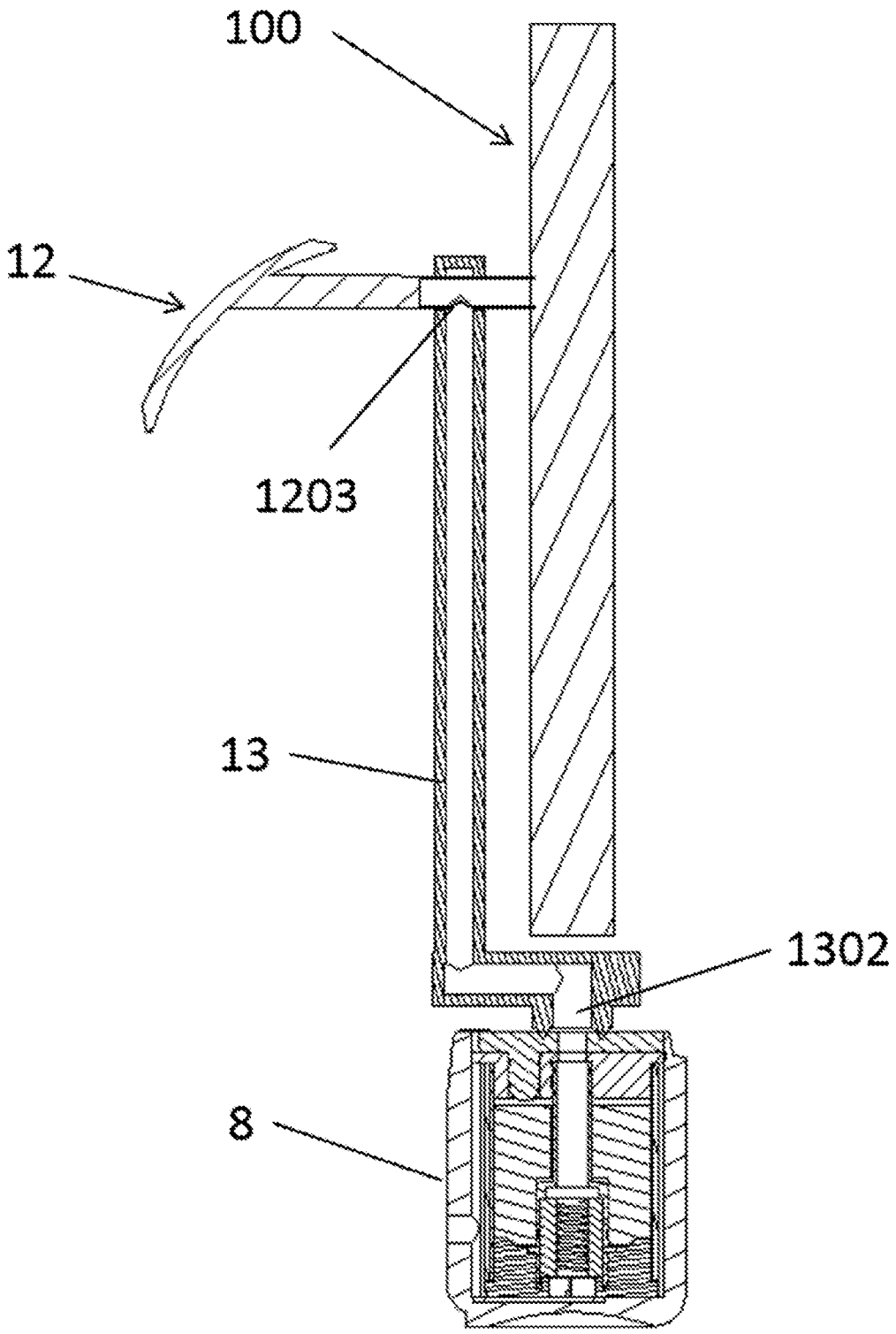
FIG. 6 depicts a cross-section view of a vapor channel of the vaporizer according to one embodiment of the present invention.
Figure 7:
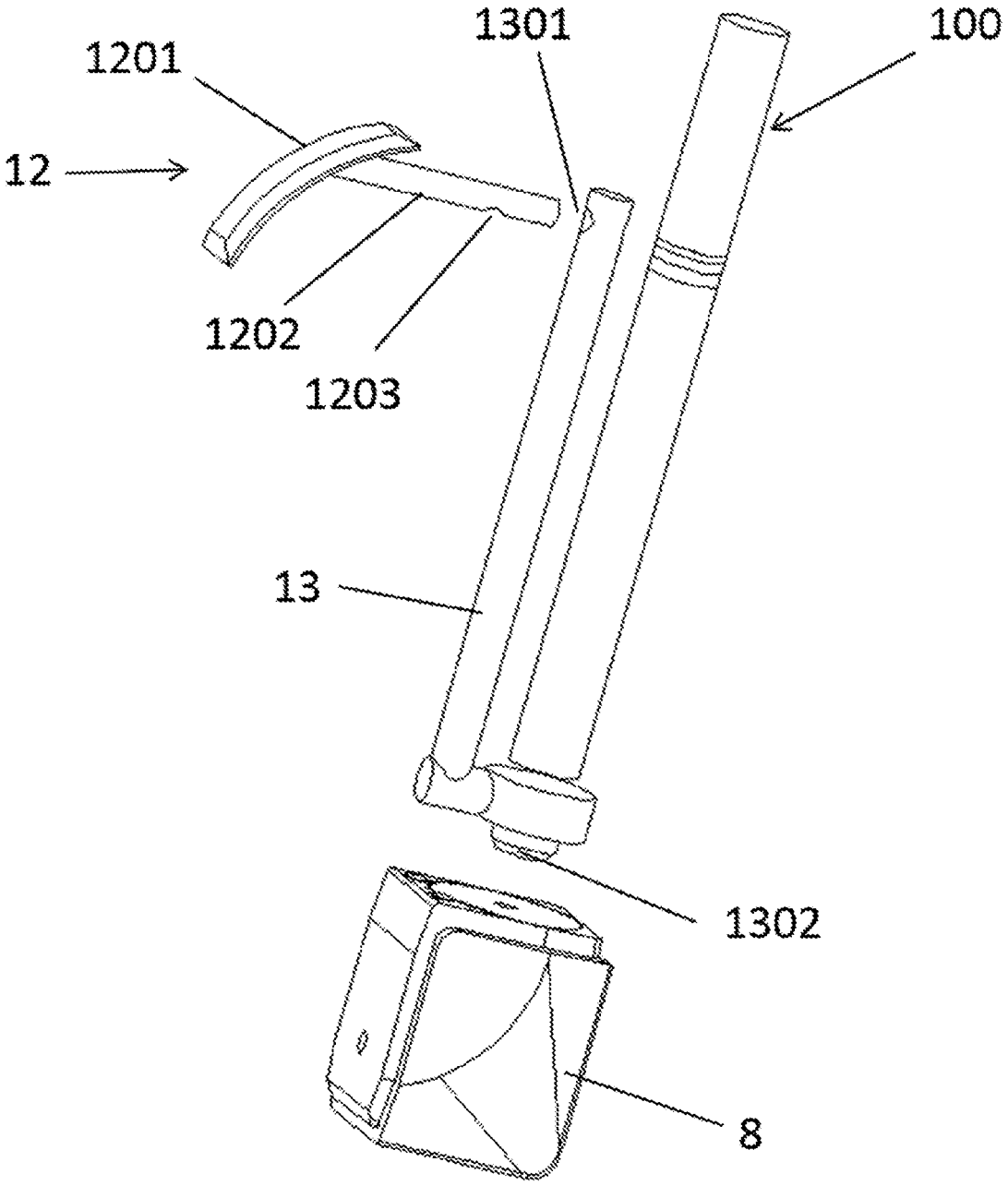
FIG. 7 depicts an exploded view of the vapor channel according to one embodiment of the present invention.

FIG. 5 depicts an exploded view of the vaporizer 8 according to one embodiment of the present invention. The vaporizer 8 includes a second heating element 808, and a liquid guiding medium 807. The second heating element 808 may be a heating wire, heating plate, or heating mesh or other heating materials. The second heating element 808 is arranged to heat a liquid so as to generate a second body of aerosol. Similarly, the second body of aerosol also looks like smoke. Preferably, the second heating element 808 is a heating wire. The vaporizer 8 is configured to store a liquid and vaporize it, where the liquid is formulated to contain chemicals to be vaporized. Generally, the liquid is intended for enriching the user experience of smoking. The liquid includes propylene glycol, glycerin and other liquid(s) with low boiling point(s), and the liquid can be one of the liquids mentioned above or any combination thereof. These aforementioned chemicals are used for producing smoke in order to enhance the user experience. Additionally, the liquid may include other types of chemicals, such as nicotine, for enhancing the taste of smoking the cigarette 100. In general, the liquid includes one or more chemicals at least one of which is selected for producing smoke or for enhancing a taste of the cigarette 100. The liquid guiding medium 807 is used for sucking the liquid to the second heating element 808 for vaporization. The liquid guiding medium 807 may comprise a porous ceramic, a wick, a cotton or a Nickle foam. Preferably, the liquid guiding medium 807 is selected to be porous ceramic. The vaporizer 8 is of a modular design and can be disassembled and assembled with the main body of the device 99; or the vaporizer 8 can also be integrated with the main body of the device 99. However, it is preferable that the vaporizer 8 is modular in design and detachably mountable to a main body of the device 99, such that the vaporizer 8 can be separated and disassembled from the main body of the device 99 to facilitate a person (e.g., the smoker) to clean the vaporizer 8 or to add the liquid. The vaporizer 8 further includes a vaporizer housing 801, two electrode pins 802, a first silicone ring 803, an insulting tube 804, a mounting block 805, a heating element fixer 806, a silicone pad 809, and a upper cover 810. The bottom of the vaporizer housing 801 is also provided with a circular concave surface, which facilitates the person to pinch the bottom of the vaporizer 8 for making disassembling of the vaporizer 8 easier. The vaporizer housing 801 is also configured to store the liquid. Hence, the liquid guiding medium 807 is used to suck the liquid from the vaporizer housing 801 to the second heating element 808, where the liquid is vaporized.

The silicone pad 809 and the upper cover 810 are provided with through holes at the center thereof and are connected to the through holes 1302 that disposed at the lower portion of the vapor channel 13 to form a passage for the second body of aerosol that is generated by the vaporizer 8 to enter the vapor channel 13. The end of the smoke guiding tube 13 is provided with a through hole 1301. The through hole 1301 is connected to the through tube 1202 of the pushrod 12. The pushrod 12 further includes a handle 1201 and an opening 1203. The end of the through tube 1202 that is away from the handle 1201 can penetrate into the filter tip of the cigarette 100. When the through tube 1202 penetrates into the cigarette 100, the opening 1203 is aligned with the vapor channel 13, and the second body of aerosol is introduced into the through tube 1202 from the vapor channel 13 and finally released out from the filter of the cigarette 100. Through such a design, the breath generated by the tobacco materials of the cigarette 100 can be released through the filter tip. Since a separate ventilation duct is provided for the vaporizer 8 without passing through the tobacco shreds, the smoke generated by the vaporizer 8 can be completely released without being adsorbed by the tobacco shreds. Thereby the amount of smoke generated is increased. (The top side of the cigarette 100 is the end that contains tobacco.)

Based on the above-described design, the heater 2 and the vaporizer 8 can be arranged to work simultaneously or independently in generating the first and second bodies of aerosol. The first and second bodies of aerosol are arranged to pass through two independent gas channels and then meet together such that the first and second bodies of aerosol are available for the smoker to inhale. In the device 99, the first and second bodies of aerosol may be arranged to be separately inhaled by the smoker, or to be inhaled simultaneously. In practical implementation, each independent gas channel may be realized as one single gas channel, or as a plurality of gas subchannels.

According to one embodiment of the present invention, the device 99 further includes a controller 7 configured to control both the heater 2 and the vaporizer 8. Preferably, when the start switch 4 is turned on, the controller 7 commands the battery 5 to supply power to the heater 2 so as to preheat the first heating element 205 in the heater 2. When preheating the first heating element 205 to a predetermined temperature is accomplished, the indicator light stops flashing and changes to a steady state, indicating that the smoker can start smoking. The preheating temperature predetermined for preheating the first heating element 205 is controlled to be below 450° C. Preferably, the preheating temperature is controlled to be in the range of 250° C. to 350° C., coinciding with the desired heating temperature of the cigarette 100. At this time, the smoker inhales at the mouthpiece of the cigarette 100 so that there is a negative pressure in the vaporizer 8 or there is an air stream flows by the vaporizer 8. The airflow sensor 9 is used for sensing whether there is such negative pressure or whether there is such air stream flowing by to thereby detect whether the smoker inhales at the mouthpiece. The airflow sensor 9 is "triggered on" under the action of the negative pressure or when such air stream flows by. After the airflow sensor 9 is triggered on, a signal is sent to the controller 7 and the controller 7 controls the battery 5 to supply power to the vaporizer 8, so that the vaporizer 8 is started. The liquid in the vaporizer 8 is heated by the second heating element 808 to generate smoke that contains the chemicals in the liquid.

Hence, with the forgoing configuration of the device 99, the first heating element 205 is preheated so that tobacco in the cigarette 100 inserted therein is heated. The low-temperature volatile matters in the tobacco can be evaporated and released into the air. After the predetermined preheating temperature is reached, the vaporizer 8 is to be turned on by the inhale of the smoker. Consequently, the liquid is heated to generate smoke. At this point, the smoker can enjoy the smoke with the smell of nicotine and the shape or an enjoyable amount of the smoke as well. By the disclosed design of the device 99, with a low heating temperature for heating the tobacco and the generation of the smoke by the vaporizer 8, it not only reduces the generation of harmful substances such as tar, carbon monoxide, etc., but also improves the user experience.

Obviously, the above-disclosed embodiments of the present invention are merely examples for clearly illustrating the present invention, rather than limiting the present invention. For those skilled in the art, other variations or changes may be made on the basis of the above description. There is no need and no exhaustion for all of the embodiments. Any modification, equivalent replacement and improvement made within the spirit and principle of the present invention should be included in the protection scope of the appended claims of the present invention.

What is claimed is:

1. A device for heating a cigarette to enable a smoker to smoke the cigarette, the device comprising:

a heater comprising a first heating element, the first heating element being arranged to heat tobacco materials in the cigarette so as to generate a first body of aerosol when the cigarette is inserted into the device; and a vaporizer comprising a second heating element, the second heating element being arranged to heat a liquid so as to generate a second body of aerosol;

wherein:

the heater and the vaporizer are arranged to work simultaneously or independently in generating the first and second bodies of aerosol; and the first and second bodies of aerosol respectively generated by the heater and the vaporizer are arranged to pass through two independent gas channels and then meet together at a filter tip of the cigarette such that the first and second bodies of aerosol are available for the smoker to inhale through the filter tip.

2. The device of claim 1, wherein the first and second bodies of aerosol are arranged to be separately inhaled by the smoker, or to be inhaled simultaneously.

3. The device of claim 1, wherein the heating temperature is not higher than 450° C.

4. The device of claim 3, wherein the heating temperature is further limited to be in a range of 250° C. to 350° C.

5. The device of claim 1, wherein the first heating element is a heating mesh.

6. The device of claim 5, wherein the heating mesh has a cylindrical shape.

7. The device of claim 5, wherein the heater further comprises:

a metal tube inserted into the heating mesh for substantially-uniformly transferring heat from the heating mesh to the cigarette.

8. The device of claim 1, wherein the first heating element has a resistance between 0.1Ω and 5.0Ω.

9. The device of claim 1, wherein the heater further comprises:

a heat insulating sleeve for heat-insulating the first heating element from a remaining part of the device.

10. The device of claim 1, wherein the vaporizer is detachably mountable to a main body of the device.

11. The device of claim 1 further comprising:

an airflow sensor for sensing whether the smoker inhales at the cigarette or not; and a controller configured to control the heater and the vaporizer;

wherein:

the controller is further configured to, after the cigarette is preheated to the heating temperature by the heater, control a battery to supply power to the vaporizer in response to the airflow sensor detecting that the smoker inhales at the cigarette.

12. The device of claim 1 further comprising:

a safety switch for sensing whether the cigarette is inserted into the device.

13. The device of claim 11, wherein the safety switch has an additional function of recording a number of individual inhales made by the smoker.

14. The device of claim 1, wherein the liquid comprises one or more chemicals at least one of which is selected for producing smoke.

15. The device of claim 14, wherein the one or more chemicals include propylene glycol (PG) or glycerin (VG).

16. The device of claim 1, wherein the liquid comprises one or more chemicals at least one of which is selected for enhancing a taste of the cigarette.

17. The device of claim 1, wherein the vaporizer comprises:

a vaporizer housing having a function of storing the liquid;

a second heating element for vaporizing the liquid; and a liquid guiding medium for sucking the liquid from the vaporizer housing to the second heating element.

18. The device of claim 1 further comprising a through tube forming at least a part of a respective gas channel through which the second body of aerosol passes, wherein an end of the through tube is penetrable into the filter tip of the cigarette.

* * * * *